United States Patent [19]

Funke

[11] 4,134,100

[45] Jan. 9, 1979

[54] FLUIDIC MUD PULSE DATA TRANSMISSION APPARATUS

[75] Inventor: Maurice F. Funke, Columbia, Md.

[73] Assignee: The United States of America as represented by the Secretary of the Army, Washington, D.C.

[21] Appl. No.: 855,863

[22] Filed: Nov. 30, 1977

[51] Int. Cl.[2] ..... G01V 1/40

[52] U.S. Cl. ..... 340/18 LD; 340/18 NC; 181/119; 175/40; 137/836

[58] Field of Search ..... 181/106, 113, 119; 175/1, 40, 48, 50, 56; 33/307; 73/665, DIG. 8; 137/810–813, 833, 835, 836; 340/18 LM, 18 NC

[56] References Cited

U.S. PATENT DOCUMENTS

| | | | |
|---|---|---|---|
| 3,237,712 | 3/1966 | Horton | 181/142 |
| 3,239,027 | 3/1966 | Schuck | 340/12 R |
| 3,331,382 | 7/1967 | Horton | 137/811 |
| 3,390,692 | 7/1968 | Hastie et al. | 325/28 |
| 3,416,487 | 12/1968 | Greene | 175/56 |
| 3,515,158 | 6/1970 | Utz | 137/81.5 |
| 3,860,902 | 1/1975 | Galle | 340/18 FM |
| 3,906,435 | 9/1975 | Lamel et al. | 340/18 NC |
| 3,909,776 | 9/1975 | Broding et al. | 181/119 |
| 3,932,836 | 1/1976 | Harrell et al. | 340/18 LD |
| 3,942,559 | 3/1976 | Kranz et al. | 137/835 |

FOREIGN PATENT DOCUMENTS

| | | | |
|---|---|---|---|
| 674,665 | 11/1963 | Canada | 137/836 |

*Primary Examiner*—Nelson Moskowitz

*Attorney, Agent, or Firm*—Nathan Edelberg; Robert P. Gibson; Saul Elbaum

[57] ABSTRACT

A mud pulse transmitter is presented for transmitting information by pressure pulses to the surface during the drilling of a borehole. A vortex valve is controlled by a fluidic feedback oscillator to generate the mud pulses. The oscillator frequency may be varied or the oscillator turned on and off by valves in the feedback paths of the oscillator, thereby permitting the transmission of information.

5 Claims, 4 Drawing Figures

FLUIDIC MUD PULSE DATA TRANSMISSION APPARATUS

RIGHTS OF THE GOVERNMENT

The invention described herein may be manufactured, used and licensed by or for the U.S. Government for governmental purposes without the payment to me of any royalty thereon.

BACKGROUND OF THE INVENTION

This invention relates to systems for transmitting information from the bottom of a bore hole to the surface by way of pressure pulses created in a circulating mud stream in the drill string. More particularly, this invention relates to an apparatus for changing the resistance to the flow of the mud stream to create pressure pulses therein.

The usefulness of obtaining data from the bottom of an oil, gas, or geothermal well during drilling operations, without interrupting those operations, has been recognized for many years. However, no proven technology reliably provides this capability. Such a system would have numerous benefits in providing for safer and less costly drilling of both exploration and production wells.

Any system that provides measurements while drilling (MWD) must have three basic capabilities: (1) to measure the downhole parameters of interest; (2) to telemeter the resulting data to a surface receiver; and (3) to receive and interpret the telemetered data.

Of these three essential capabilities, the ability to telemeter data to the surface is currently the limiting factor in the development of an MWD system. The use of bottom-hole recorders has demonstrated the ability of currently available sensors to continuously measure the bottom-hole environment.

For safety, it is of interest to predict the approach of high-pressure zones to allow the execution of the proper kick preventative procedures. A downhole temperature sensor and gamma-ray log would be useful for this prediction. The downhole sensing of a kick would give the driller an earlier, more accurate warning than is currently available in this potentially dangerous situation. To save time and significantly reduce costs, continuous measurement of the drill bit's position would be useful during directional drilling operations.

While several downhole sensors are in general field use, none provide a signal to the surface without interrupting the drilling operation or requiring special "trips" be made when the drill string length is to be changed.

Four general methods are being studied that would provide transmission of precise data from one end of the well bore to the other: mud pressure pulse, hard wire, electromagnetic waves, and acoustic methods. At this time, the mud-pressure-pulse method seems to be closest to becoming commercially available.

The method currently being pursued to generate mud pressure pulses involves the use of a mechanical valve to modulate the resistance to the flow of the mud through the drill string. The advantages of this method are a relatively high-speed signal transmission (about 4000 to 5000 feet per second) and ready adaptability to existing equipment. (The only required modification to downhole equipment is the addition of a special drill collar near the bit that contains the pressure-pulse generating valve, the downhole sensors, and the related control apparatus). The disadvantages of this method are a relatively slow data rate (from 6 to 60 seconds for each measurement) and the poor reliability of mechanically moving parts exposed to the downhole environment.

SUMMARY OF THE INVENTION

Accordingly it is an object of this invention to provide a mud pulse transmitter having a higher data transmission rate.

It is a further object of this invention to provide a mud pulse transmitter utilizing fluidic components to eliminate the sealing problems associated with moving part valves.

Yet another object of this invention is to provide a mud pulse transmitter capable of controlling the full mud flow by mechanically valving a small amount of flow in a control path.

To achieve the above objects the present invention utilizes a vortex valve controlled by a fluidic feedback oscillator. One of the output channels of the oscillator supplies the tangential inlets of the vortex valve while the other oscillator output bypasses the vortex valve. The main or radial inlets of the vortex valve are supplied by the main mud flow. Since the vortex valve will be throttled when it receives flow in its tangential inlets and open when there is no fluid supplied to the tangential inlets, the vortex valve will produce pressure oscillations in the upstream main mud flow corresponding to the oscillations produced by the feedback oscillator. The oscillations are controlled by restricting flow in the feedback channels of the fluidic feedback oscillator.

Additional objects, features, and advantages of the instant invention will become apparent to those skilled in the art from the following detailed description and attached drawings on which, by way of example, only the preferred embodiment of the instant invention is illustrated.

DESCRIPTION OF THE PREFERRED EMBODIMENT

Figure 1:
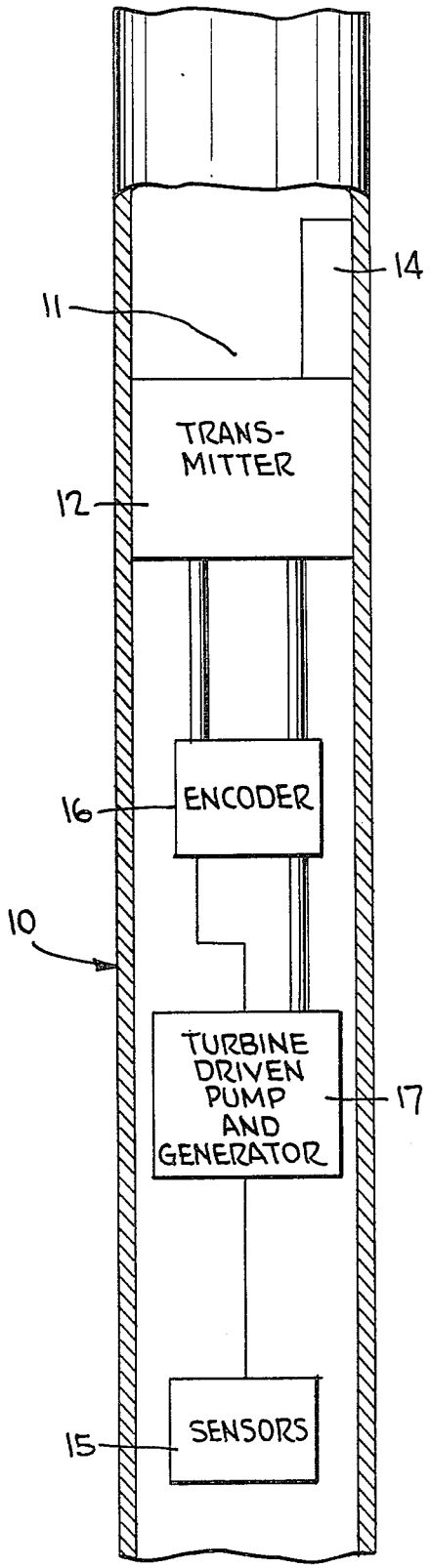
FIG. 1 is a schematic view of the transmitter of the present invention as it will appear coupled in a drill string.

Referring to FIG. 1, there is shown a portion of the drill string 10 housing the telemetry equipment of the present invention. The drill string 10 is rotated by a typical drilling rig (not shown) to drive a rotary drill bit (not shown) to excavate a borehold through the earth. While drill string 10 is being rotated substantial quantities of a suitable drilling fluid, drilling mud, are continuously circulated down through the drill string to cool the drill bit, counter pressure formation fluids, and carry earth borings to the surface. As is well known in the art, the mud stream flowing down through the drill string is well suited for the transmission of pressure signals to the surface at the speed of sound in the particular mud stream.

In accordance with the principles of the present invention, data transmitting means 11, including vortex triode 12 controlled by fluidic feedback oscillator 14, is located in a segment of drill string 10. Transmitter 11 serves to produce pressure signals in the drilling mud which are transmitted to the surface and decoded by suitable signal detecting and recording devices, as is well known in the art. Transducers 15 are provided to sense such downhole conditions as pressure, temperature, and drill-bit position information as well as various other conditions. The transducers 15 produce electrical signals which are coupled to encoder 16 to produce digital hydraulic signals to control the feedback paths of fluidic oscillator 14, thereby controlling transmitter 11. Hydraulic oil pressure as well as electrical power is generated by a mud powered turbine 17. This turbine 17 provides power to transducers 15 and encoder 16.

Figure 2:
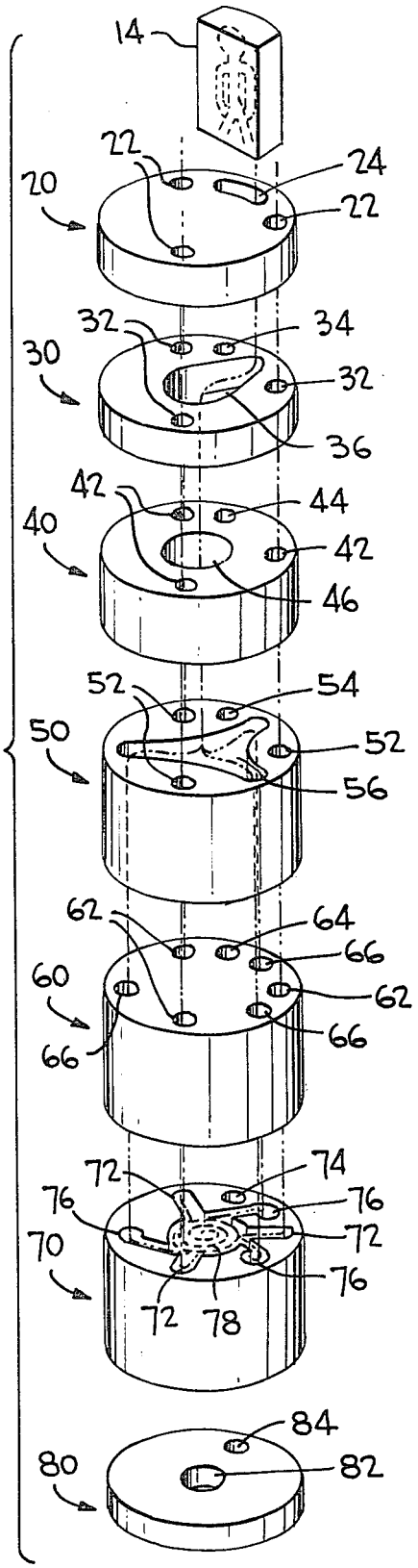
FIG. 2 is an exploded view of the transmitter of the present invention.

Turning now to FIG. 2, there is depicted an exploded view of transmitter 11. Transmitter 11 includes fluidic feedback oscillator 14 mounted on oscillator mounting section 20, first and second adapter sections 30 and 40, control manifold section 50, inlet section 60, vortex section 70, and discharge section 80. Sections 20, 30, 40, 50, 60, 70 and 80 are each designed to have a constant cross-section for ease of manufacture. The sections are all diffusion bonded together in one segment of the drill string.

Sections 60, 70 and 80 form a vortex triode while sections 20, 30, 40 and 50, in effect, form a manifold enabling fluidic oscillator 14 to control the triode. Some of the mud flow coming down the drill string 10 will pass through transmitter 11 by means of passages 22, 32, 42, 52 and 62. When the main flow reaches vortex section 70 it will enter vortex chamber 78 by way of main radial inlets 72. The flow will then exit from vortex chamber 78 by way of vortex drain 82.

The discharge end of fluidic oscillator 14 is mounted in hole 24 of oscillator mounting section 20. Oscillator 14 has two outlets and is mounted so that one outlet discharges into passage 34 and the other outlet discharges into passage 36 of first adapter section 30. Oscillator 14 switches its discharge from one outlet to the other, in a manner to be discussed subsequently, thereby controlling the operation of the vortex triode. The two diverging paths taken by the discharge of oscillator 14 are a bypass, formed by passages 34, 44, 54, 64, 74 and 84, and a control path formed by passages 36, 46, 56, 66 and terminating in tangential control inlets 76. When oscillator 14 is discharging to the bypass no flow will pass through the tangential control inlets 76. Accordingly, the main flow will pass through radial inlets 72 and flow radially into vortex chamber 78 and axially out vortex drain 82, with no tangential velocity component. With no tangential velocity component, the flow through vortex chamber 78 encounters relatively little flow resistance. Now when the output oscillator 14 is switched to the control path, the control flow will enter vortex chamber 78 through tangential control inlets 76. The tangential control flow will induce vortex flow in vortex chamber 78 and greatly increase the flow resistance to the main flow, as is well known in art. Thus, as the output of oscillator 14 switches back and forth between the bypass and control path, pressure oscillators will be created in the main flow which will be transmitted upstream to the surface at the speed of sound in the drilling mud. The main and control flow paths should be sized such that when main and control flow exist simultaneously in said vortex valve, the two flow rates are approximately equal.

Figure 3:
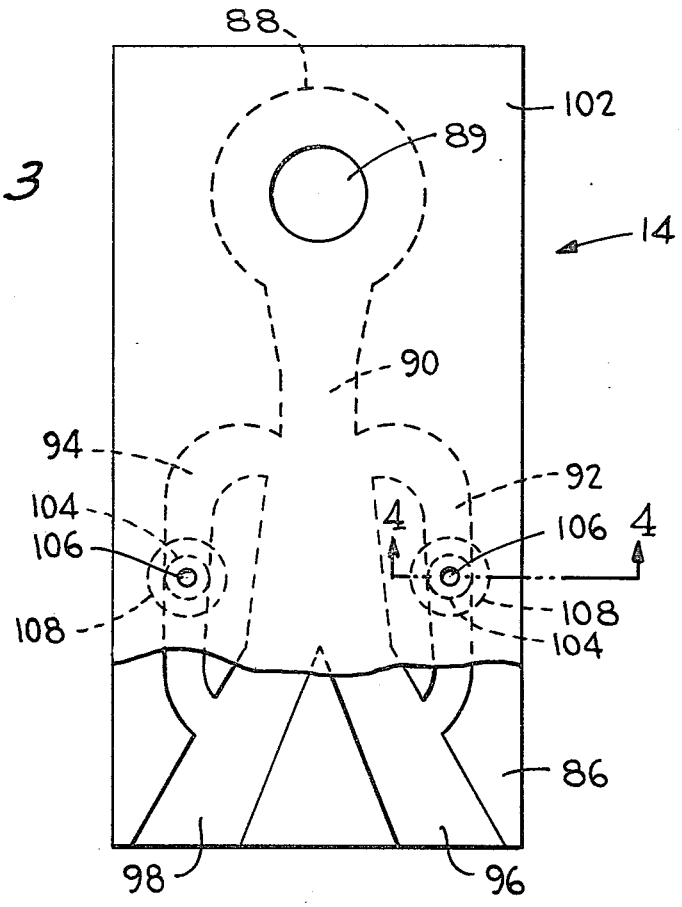
FIG. 3 is a detailed view of the fluidic feedback oscillator illustrated in FIG. 2.

FIG. 3 shows fluidic oscillator 14 with its cover partially removed. The oscillator passages are formed by milling out the channels in block 86. Fluid, drilling mud, is supplied to power chamber 88 through a hole 89 in the coverplate 102. The mud exits power chamber 88 through power nozzle 90 which forms the flow into a jet. The jet then flows out one of the outlets 96 and 98. If, for example, the jet flow is through outlet 96, some of the flow will be fed back through feedback channel 92. This feedback flow will serve to deflect the power jet to outlet 98 whereupon feedback channel 94 will serve to deflect the power jet back to outlet 96. In this manner the output from oscillator 14 will oscillate between outlets 96 and 98. Thus, as described above, the fluidic feedback oscillator 14 will cause the vortex triode formed by sections 60, 70 and 80 to cycle between its high and low flow resistance modes of operation. The oscillator 14 is designed to have sufficient hysteresis in its input-output transfer characteristic so that partially closing a feedback passage 92 or 94 will drop the pressure in the feedback line to a valve below that required to make the amplifier switch, thereby preventing oscillation. It will be recognized that as feedback passage 92 or 94 is gradually closed the period of oscillation of oscillator 14 will increase until it ceases to oscillate.

Figure 4:
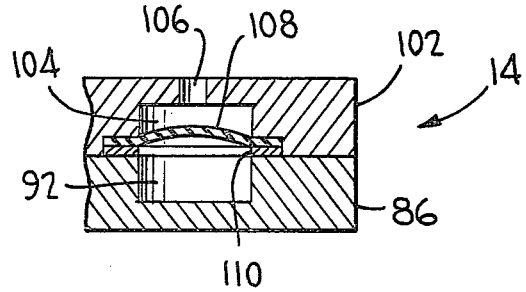
FIG. 4 shows a detailed section view (4—4) of one embodiment of the variable resistor used in the feedback paths of the oscillator of FIG. 3.

To control the operation of fluidic feedback oscillator 14 and thus enable the transmission of information by the system a hydraulically operated feedback valve is placed in each of the feedback passages 92 and 94. FIG. 4 shows details of the valve for feedback passage 92. The valve structure is formed in oscillator cover 102. A cavity 104 in oscillator cover 102 is closed by diaphragm 108. Diaphragm 108 is held in place by ring 110 which is attached to cover 102 by screws, not shown. Cavity 104 communicates with the hydraulic output of encoder 16 by means of hydraulic lines (not illustrated) connected to inlet 106. When hydraulic pressure is applied to the diaphragm 108 by encoder 16, diaphragm 108 will be forced into feedback passage 92, thereby partially blocking the mud flow. Thus oscillator 14 may be switched off by pressurizing the diaphragm 108 in either of the feedback passages 92 or 94, with the oscillator output exiting through either of outlets 96 or 98, depending on which of the feedback passages 92 and 94 is partially blocked.

From the foregoing it can be seen that transmitter 12 will create pressure pulses in the drilling mud controlled by hydraulic pulses supplied by encoder 16. It will be appreciated that the present invention has provided new and improved apparatus for producing pressure signals in a mud stream capable of carrying information from the bottom of a bore hole to the surface.

Though a single preferred embodiment has been shown and described it will be recognized that various modifications and substitutions may be made thereto without departing from the spirit and scope of the invention. For example, it will be recognized that fluidic feedback oscillator 14 would have the same effect if it were designed to have little or no hysteresis and the valves in feedback passages 92 and 94 were designed to fully close. Accordingly, I wish it to be understood that I do not desire to be limited to the exact details of construction shown and described, for obvious modifications can be made by a person skilled in the art.

I claim:

1. Telemetry apparatus for transmitting data from sensors to the surface during the drilling of a bore hole by generating pressure pulses in a drilling fluid in a drill string, the apparatus comprising:

a vortex valve means, having a vortex chamber which includes radial main inlet ports through which a first portion of said drilling fluid flows, tangential control inlet ports, and an axial outlet, to create a vortex flow in said vortex chamber and thus a high resistance to flow from said inlets to said outlet when fluid is supplied to said control ports and to create substantially radial flow in said vortex chamber and thus a low flow resistance when no fluid is supplied to said control ports; and a fluidic feedback oscillator having a power jet supplied by a second portion of said drilling fluid, said oscillator including a first output channel connected to said control inlet ports, a second output channel connected to discharge fluid downstream of said vortex valve, and a means to control the frequency of oscillation of said oscillator in response to signals from said sensors;

whereby pressure pulses are generated in said drilling fluid in said drill string at a frequency corresponding to the frequency of oscillation of said oscillator and are communicated to the surface.

2. The apparatus of claim 1 wherein said fluidic feedback oscillator further comprises a feedback channel and said adjustment means to control comprises a feedback valve in said feedback channel.

3. The apparatus of claim 2 wherein said feedback valve is hydraulically controlled.

4. The apparatus of claim 2 wherein said fluidic feedback oscillator has sufficient hysteresis in its input-output transfer characteristic that partial closing of said feedback valve will prevent said oscillator from oscillating.

5. The apparatus of claim 4 wherein said feedback valve comprises a diaphragm forming part of a wall of said feedback channel.

* * * * *